US008622214B1

(12) United States Patent
Monjello et al.

(10) Patent No.: US 8,622,214 B1
(45) Date of Patent: Jan. 7, 2014

(54) KEEPSAKE ARRANGEMENT AND METHOD OF MAKING A KEEPSAKE

(76) Inventors: Donald Monjello, Long Beach, NY (US); Jeffrey Monjello, Long Beach, NY (US)

( * ) Notice: Subject to any disclaimer, the term of this patent is extended or adjusted under 35 U.S.C. 154(b) by 0 days.

(21) Appl. No.: 12/608,504

(22) Filed: Oct. 29, 2009

(51) Int. Cl.
*B65D 73/00* (2006.01)

(52) U.S. Cl.
USPC ..... 206/457; 206/731; 206/733; 206/748

(58) Field of Classification Search
USPC ..... 206/457, 204, 731, 733, 734, 748, 751; 40/362, 376, 459, 700, 709
See application file for complete search history.

(56) References Cited

U.S. PATENT DOCUMENTS

| | | | | |
|---|---|---|---|---|
| 2,558,650 | A * | 6/1951 | Heineman et al. | 206/525 |
| 2,591,565 | A | 4/1952 | Linnard | |
| 4,718,550 | A * | 1/1988 | Johnson | 206/387.13 |
| 5,167,085 | A * | 12/1992 | Yang | 40/711 |
| 5,695,066 | A | 12/1997 | Bartlett | |
| 5,865,307 | A * | 2/1999 | Friedman | 206/37.1 |
| 5,950,299 | A | 9/1999 | Perez-Alderete | |
| 6,062,385 | A * | 5/2000 | Cho | 206/373 |
| 6,321,476 | B2 | 11/2001 | Parini | |
| D484,320 | S | 12/2003 | Sakaguchi | |
| 6,730,494 | B1 * | 5/2004 | Toranto et al. | 435/28 |
| D531,800 | S | 11/2006 | Sakaguchi | |
| 2002/0139708 | A1 * | 10/2002 | Lien | 206/534 |
| 2003/0004740 | A1 | 1/2003 | Dickey et al. | |
| 2004/0163299 | A1 * | 8/2004 | Werb | 40/800 |
| 2005/0045521 | A1 * | 3/2005 | Johnson et al. | 206/545 |
| 2006/0016710 | A1 * | 1/2006 | Kosann et al. | 206/455 |
| 2006/0226164 | A1 * | 10/2006 | Graham | 220/840 |
| 2008/0006557 | A1 * | 1/2008 | Wang | 206/457 |
| 2008/0098638 | A1 * | 5/2008 | Goppion | 40/712 |

* cited by examiner

*Primary Examiner* — Mickey Yu
*Assistant Examiner* — Rafael Ortiz
(74) *Attorney, Agent, or Firm* — Carmody & Torrance LLP

(57) ABSTRACT

A keepsake arrangement comprising a cavity defined by at least one cavity wall and having an opening, an impressible material disposed in the cavity, a seal, sealingly coupled to a lip about the cavity, for sealing the impressible material in the cavity and for maintaining moisture in the impressible material while the seal is sealingly coupled to the lip about the cavity, a frame releasably coupleable to at least a portion of the lip that extends about the cavity, the frame comprising a shoulder section that extends over the opening when the frame is coupled to the at least one cavity wall, wherein the shoulder section is dimensioned to assist in retaining the impressible material in the cavity when the seal is removed from the lip about the cavity and the moisture is removed from the impressible material. A method of making a keepsake utilizing a keepsake arrangement as disclosed herein is also provided.

13 Claims, 4 Drawing Sheets

KEEPSAKE ARRANGEMENT AND METHOD OF MAKING A KEEPSAKE

BACKGROUND OF THE INVENTION

The present invention is directed generally to keepsake arrangements and in particular, to an improved keepsake arrangement that utilizes a seal for sealing an impressible material and a pressfitted and/or otherwise releasably coupleable frame to assist in keeping the impressible material in the cavity once the seal is removed. In this way, and with the preferred embodiments set forth herein, an improved and more user friendly keepsake arrangement is provided. An improved method of making a keepsake utilizing an improved keepsake arrangement is also provided.

Keepsake arrangements are known in the art. One such arrangement is described in U.S. Pat. No. 2,591,565. In particular, this '565 patent describes the use of clay that is kept impressible while inside a receptacle. Prior to making an impression in the clay, a moisture proof cover is removed. However, after the impression is made, the receptacle containing the clay must be clamped to the back of a frame using a plurality of components, such as clamping elements, nuts and bolts. In addition, the arrangement as described depends in part on the pressure of the hand (or other) print for causing the clay to sufficiently be displaced so as to rise above the edges of the pan. Among other things, such an arrangement is perceived to be cumbersome, time-consuming and/or less than very easy to construct and hence, less than very user friendly. Accordingly, deficiencies in the art are believed to exist.

It is thus desirable to overcome the deficiencies in the prior art. For example, it would be advantageous and desirable to provide a keepsake arrangement that is easy to use, that can be easily and quickly constructed and that is aesthetically pleasing. Such a construction and method of use is provided by the present invention.

It is thus evident that the present invention overcomes the perceived deficiencies in the prior art noted above and further achieves the aforementioned and below mentioned objectives.

SUMMARY AND OBJECTIVES OF THE INVENTION

Accordingly, it is an objective of the present invention to provide a keepsake arrangement that overcomes the deficiencies in the prior art.

Another objective of the present invention is to provide a keepsake arrangement that is easy to use, that can be easily and quickly constructed and that is aesthetically pleasing.

In particular, another objective of the present invention is to provide a keepsake that can be quickly created, does not require complicated assembly components and is very easily and quickly ready to provide to the person desiring the keepsake memorabilia.

Another objective is to provide such a keepsake arrangement that can be economically manufactured.

Still a further objective is to provide a keepsake arrangement that can act as a shadow box for aesthetics.

Yet another object of the present invention is to provide an improved method of making a keepsake using the keepsake arrangement as disclosed herein.

Still other objects and advantages of the invention will in part be obvious and will in part be apparent from the specification.

The invention accordingly comprises the features of construction, combination of elements, arrangement of parts and sequence of steps which will be exemplified in the construction, illustration and description hereinafter set forth, and the scope of the invention will be indicated in the claims.

Generally speaking, in accordance with the present invention, an improved keepsake arrangement and method of making a keepsake is provided. In a first embodiment, the keepsake arrangement comprises a cavity defined by at least one cavity wall, the cavity having an opening; an impressible material disposed in the cavity; a seal, sealingly coupled to a lip about the cavity, for sealing the impressible material in the cavity and for maintaining moisture in the impressible material while the seal is sealingly coupled to the lip about the cavity; a frame releasably coupleable to at least a portion of the lip that extends about the cavity, the frame comprising a shoulder section that extends over at least part of the opening when the frame is coupled to the at least one cavity wall; wherein the shoulder section is dimensioned to assist in retaining the impressible material in the cavity when the seal is removed from the lip about the cavity and the moisture is removed from the impressible material.

In an alternative embodiment, the keepsake arrangement comprises a cavity defined by at least one cavity wall, the cavity having an opening; an impressible material disposed in the cavity; a seal, sealingly coupled to a lip about the cavity, for sealing the impressible material in the cavity and for maintaining moisture in the impressible material while the seal is sealingly coupled to the lip about the cavity; a frame pressfittedly coupleable to at least a portion of the lip that extends about the cavity, the frame comprising a shoulder section that extends over at least part of the opening when the frame is coupled to the at least one cavity wall; wherein the shoulder section is dimensioned to assist in retaining the impressible material in the cavity when the seal is removed from the lip about the cavity and the moisture is removed from the impressible material.

In yet another embodiment, a method of making a keepsake utilizing a keepsake arrangement as disclosed herein is provided. In such a preferred embodiment, the method comprises the steps of removing the seal from the lip about the cavity; making an impression in the impressible material; and coupling the frame to the at least portion of the lip; whereby the shoulder section assists in retaining the impressible material in the cavity when the seal is removed from the lip about the cavity and the moisture is removed from the impressible material.

In a preferred embodiment, the impressible material is an air dry modeling compound and the impression is that of a paw print of a pet.

BRIEF DESCRIPTION OF THE DRAWINGS

For a fuller understanding of the invention, reference is had to the following description taken in connection with the accompanying figures, in which.

Identically numbered elements in the various figures are intended to designate like elements, although not every element in every figure is so labeled.

DETAILED DESCRIPTION OF THE PREFERRED EMBODIMENTS

Reference is made to generally to FIGS. 1-4 in connection with preferred embodiments of the present invention, which include preferred constructions of the keepsake arrangement and methods of making a keepsake using the keepsake arrangements disclosed herein.

Figure 1:
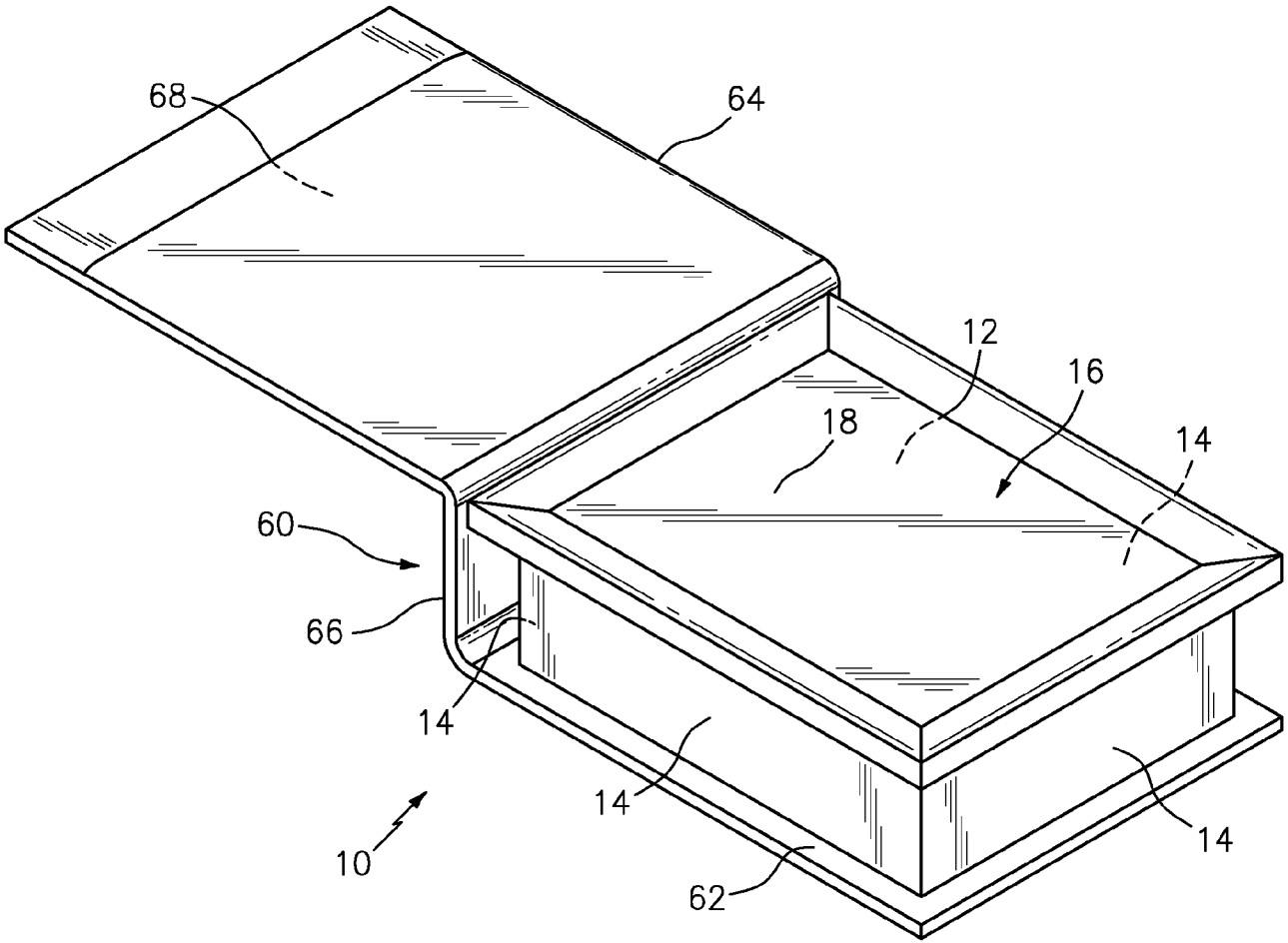
FIGS. 1-4 are perspective views of a keepsake arrangement constructed in accordance with preferred embodiments of the present invention and in various open and closed positions, particulars and details of which are more fully disclosed herein.
Figure 2:
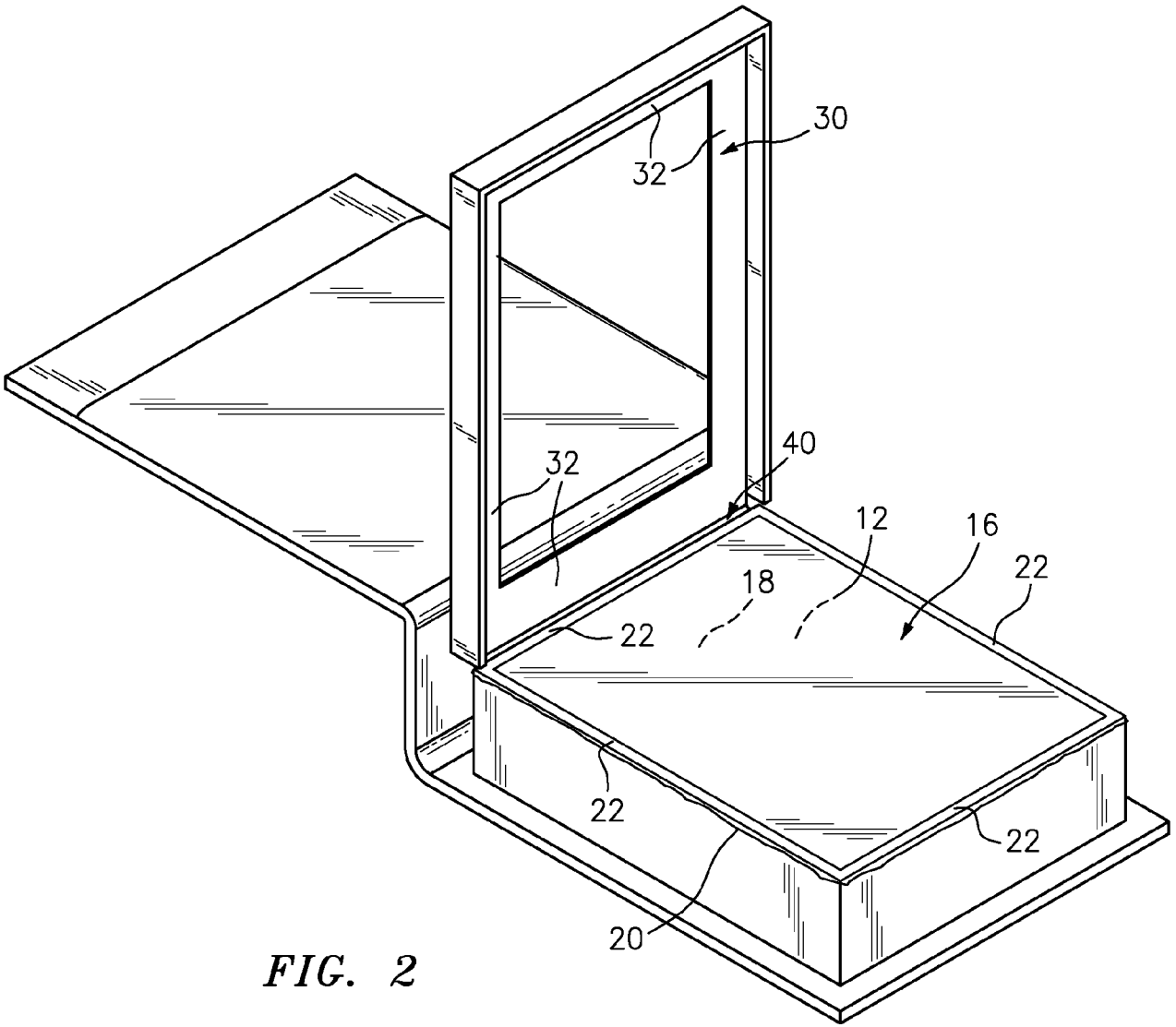

As shown in the figures, the preferred embodiments are generally directed to a keepsake arrangement, generally indicated at 10, constructed in accordance with the present invention. In a first preferred embodiment, keepsake arrangement 10 comprises a cavity 12 defined by at least one cavity wall, generally indicated at 14. As can be seen in FIG. 1 for example, four (4) walls define cavity 12. Walls 14 may be separate walls, or, as in the preferred embodiment, are integrally molded walls preferably from plastic. On this point, it should also be understood that while in this first embodiment, cavity 12 is rectangular in shape, this is by example and not limitation, as it should be understood that cavity 12 can be any number of shapes, including round, oval, among others. It will also be noted that the claims are not limited by the shape of the cavity. Cavity 12 has an opening that is indicated by reference number 16.

In a completed keepsake arrangement, an impressible material 18 will be disposed in the cavity 12. In a preferred embodiment, the impressible material is an air dry modeling compound. Through extensive experimentation it has been found that an air dry modeling compound sold under the brandname DELIGHT works the best in connection with the objectives of the present invention.

In connection therewith, a seal 20 is sealingly coupled to a lip 22 about the cavity, for sealing the impressible material 18 in the cavity 12 and for maintaining moisture in the impressible material 18 while the seal 20 is sealingly coupled to the lip 22 about the cavity. In a preferred embodiment, the seal 20 is heat-sealed to the lip 22 about the cavity, but other means of sealing are well within the purview of one skilled in the art, such as through the use of adhesives or the like.

Keepsake arrangement 10 further comprises a frame, generally indicated at 30, that is releasably coupleable to at least a portion of the lip 22 that extends about the cavity 12. In a preferred embodiment, frame 30 is releasably coupleable to the lip 22 that extends about the cavity. That is, preferably frame 30 extends around the entire cavity as clearly illustrated in FIGS. 1 and 3. However, those skilled in the art will recognize that while preferred, frame 30 need not extend all the way around.

Frame 30 includes a shoulder section 32 that preferably extends about the entire frame. Here too, although preferred, those skilled in the art will recognize that shoulder section need not extend all the way around. In the preferred embodiment, shoulder section 32 extends over at least a part of the opening 16 when the frame 30 is coupled to the cavity wall(s).

As illustrated and preferred, the shoulder section 32 is dimensioned to assist in retaining the impressible material 18 in the cavity 12 when the seal 20 is removed from the lip 22 about the cavity 12 and the moisture is removed from the impressible material. By this it is meant that exposure to the air will cause the impressible material to lose its moisture and contract in size. Therefore, without some means of retaining the material 18 within the cavity, it is more likely to fall out undesirably. The use of a shoulder section that extends at least partially into the opening reduces and/or eliminates this possibility.

In a specific embodiment, frame 30 may be hingedly coupled to the at least one cavity wall 14 such that the frame 30 can be coupled and decoupled from the lip 22 about the cavity by pivoting of the frame relative to the cavity. To achieve this, a hinge 40 (FIG. 2) may be provided to hingedly couple the frame 30 to the at least one cavity wall 14. In a preferred embodiment, the frame 30 and the hinge 40 are integrally formed from plastic. Further, as the entire keepsake arrangement is preferably molded from plastic, hinge 40, lip 22 and frame 30 may all be integrally formed from molded plastic.

Figure 3:
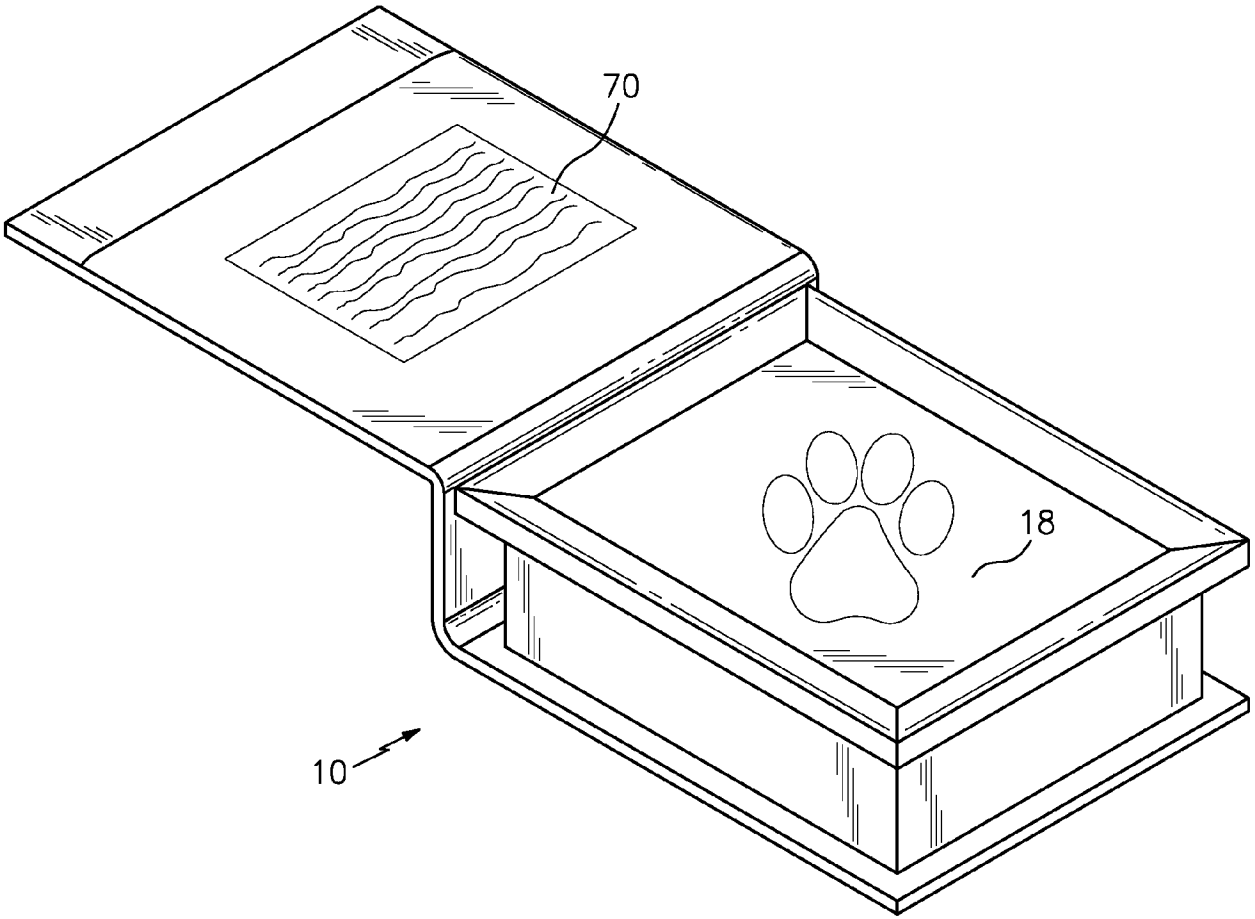
Figure 4:
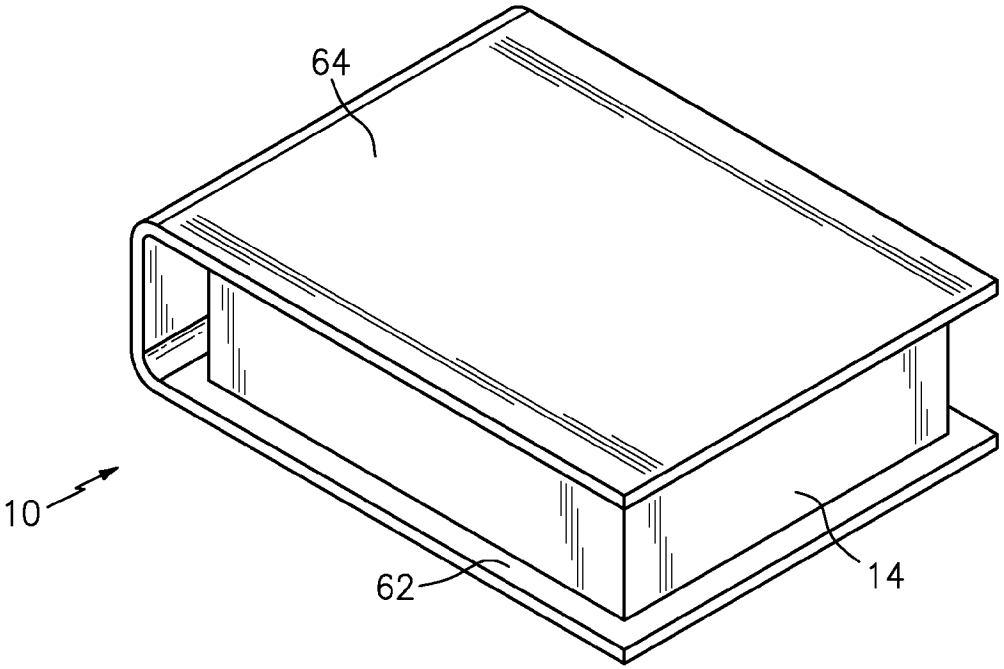

As illustrated in FIG. 3, a preferred usage of the present invention is in connection with pet memorabilia, and in particular, wherein the air dry modeling compound is impressed with the paw print of a pet. However, as should be understood, this is by way of a preferred example of an imprint and not by limitation.

In connection with further optional but preferably includable details in connection with the objectives set forth herein, keepsake arrangement 10 may further comprise a housing, generally indicated at 60, wherein the housing comprises at least (i) a base 62 for supporting the cavity 12 and (ii) a flap 64, coupled to the base such as by member 64, for covering the frame 30 when the flap 64 is in a closed position (FIG. 4) and for exposing the frame 30 and the impressible material 18 when the flap 64 is in an open position (e.g. FIGS. 1, 3). In a preferred embodiment, housing could be made from leather or faux leather or another aesthetically appealing material.

In connection with the objectives set forth herein, a preferred embodiment of the present invention also provides for flap 64 to comprise a transparent sleeve 68 (FIG. 1, 3). In this way, and by way of example and not limitation, a photo or picture (e.g. of the pet) and/or a spiritual, emotional and/or inspirational writing 70 (see FIG. 3) can be inserted (and removed if desired) into the sleeve 68. As illustrated and preferred, writing 70 is viewable through the sleeve 68 and is readable by a person when the flap is in the opened position.

With a preferred embodiment of the keepsake arrangement now disclosed, reference may also be had to the figures in connection with another preferred embodiment of the invention, namely a method of making a keepsake utilizing a keepsake arrangement. Preferably, the keepsake arrangement used in connection with such a preferred method is illustrated herein, but for completeness and non-ambiguousness, comprises a cavity 12 defined by at least one cavity wall 14, the cavity having an opening 16; an impressible material 18 disposed in the cavity 12; a seal 20, sealingly coupled to a lip 22 about the cavity, for sealing the impressible material 18 in the cavity 12 and for maintaining moisture in the impressible material 18 while the seal 20 is sealingly coupled to the lip 22 about the cavity; a frame 30 releasably coupleable to at least a portion of the lip that extends about the cavity, the frame 30 comprising a shoulder section 32 that extends over at least part of the opening 16 when the frame 30 is coupled to the at least one cavity wall 14; wherein the shoulder section 32 is dimensioned to retain the impressible material 18 in the cavity when the seal 20 is removed from the lip 22 about the cavity 12 and the moisture is removed from the impressible material.

Therefore and in accordance with a preferred embodiment, the method comprises the steps of removing the seal 20 from the lip 22 about the cavity 12, making an impression in the impressible material 18 and coupling the frame 30 to the at least portion of the lip 22, whereby the shoulder section 32 assists in retaining the impressible material 18 in the cavity 12 when the seal 20 is removed from the lip 22 about the cavity 12 and the moisture is removed from the impressible material.

In a specific embodiment, and as disclosed above, the keepsake arrangement 10 may comprise comprising a housing 60 comprising a base 62 for supporting the cavity 12, and a flap 64 coupled to the base 62 for covering the frame 30 when the flap 64 is in a closed position and for exposing the frame 30 and the impressible material 18 when the flap 64 is in an open position, wherein, and prior to the step of removing the seal 20 from the lip 22 about the cavity, the method comprises the steps of placing the flap 64 of the housing 60 in the open position; decoupling the frame 30 from the at least portion of the lip 22 and thereafter making an impression in the impressible material 18; and then press-fittingly coupling the frame to the at least portion of the lip.

In another specific embodiment, the frame 30 may be is hingedly coupled to the at least one cavity wall 14 such that the frame 30 can be coupled and decoupled from the lip 22 about the cavity 12 by pivoting of the frame relative to the cavity 12, wherein the method comprises the steps of decoupling the frame from the at least portion of the lip by rotating the frame about the hinge 40 and press-fittingly coupling the frame to the at least portion of the lip by rotating the frame about the hinge 40.

In each of the aforementioned embodiments, frame 30 may merely be releasably coupled and releasably locked onto wall(s) 14 by a pressfit engagement, with or without a hinge. However, frame 30 could also (or alternatively) be releasably coupled to wall(s) 14 by means of a snap, lock, latch or other types of securing means, all of which is well within the purview of the skilled artisan. Such additional locking could be used to further ensure that the impressible material 18 does not undesirably or prematurely fall out of cavity 12. Likewise, as the present invention is preferably directed to the imprinting of a pet's paw print, the method may also comprise the step of making an impression in the impressible material with the paw print of a pet.

Therefore, and to be sure, the keepsake arrangement may comprise a cavity defined by at least one cavity wall, the cavity having an opening; an impressible material disposed in the cavity; a seal, sealingly coupled to a lip about the cavity, for sealing the impressible material in the cavity and for maintaining moisture in the impressible material while the seal is sealingly coupled to the lip about the cavity; a frame pressfittedly coupleable to at least a portion of the lip that extends about the cavity, the frame comprising a shoulder section that extends over the opening when the frame is coupled to the cavity; wherein the shoulder section is dimensioned to assist in retaining the impressible material in the cavity when the seal is removed from the lip about the cavity and the moisture is removed from the impressible material. In this pressfitting arrangement, the frame may likewise be hingedly coupled to the at least one cavity wall such that the frame can be coupled and decoupled from the lip about the cavity by pivoting of the frame relative to the cavity. Hinge 40 as disclosed herein, may be used to achieve this construction.

As alluded to above, a preferred material for keepsake arrangement 10 is plastic, but other materials, dictated by cost and other relevant factors, can be used in place thereof. Such is the case with the optional but preferred housing 60 as set forth above. In addition, frame 30 is shown herein as being open within shoulders 32, but if a further layer of material is desired, for example, so as not to contact material 18 after the impression has been done, glass or transparent (and presumably hard) plastic could also be provided and is within the scope of the invention. In addition, the use of a frame and shoulder section 32 that extends into the opening as disclosed herein can conceal uneven edges of the impressible material 18 that may form as the material dries, contracts and hardens. In this way, keepsake arrangement 10 as illustrated for example in FIG. 3, is even more aesthetically pleasing and ready to be displayed.

It can thus be seen that the present invention provides numerous advantages not found in the prior art. For example, the present invention provides an improved keepsake arrangement that overcomes the deficiencies in the prior art. Moreover, the present invention is easy to use, can be easily and quickly constructed and is aesthetically pleasing, all of which are improvements over the prior art. For example, the present invention can be quickly created, does not require complicated assembly components and is very easily and quickly ready to provide to the person desiring the keepsake memorabilia. Also, because of the sealed impressible material, storage of the present invention, for example in a Veterinarian's office for long periods of time prior to its opening and use, is possible with the invention as constructed. As would also now be understood by those skilled in the art, the present invention can be economically manufactured. The present invention also provides for an improved method of making a keepsake using the keepsake arrangement for the reasons disclosed herein.

While the invention has been particularly shown and described with respect to preferred embodiments thereof, it will be understood by those skilled in the art that changes in form and details may be made therein without departing from the scope and spirit of the invention.

What is claimed is:

1. A keepsake arrangement, the keepsake arrangement comprising:

a cavity defined by at least one cavity wall, the cavity having an opening and a lip that borders the opening;

an impressible material disposed in the cavity;

a seal, sealingly coupled to the lip about the cavity, for sealing the impressible material in the cavity and for maintaining moisture in the impressible material while the seal is sealingly coupled to the lip about the cavity;

a frame releasably mountable on at least a portion of the lip that extends about the cavity, the frame comprising a shoulder section that extends over at least part of the opening when the frame is coupled to the at least one cavity wall;

wherein the shoulder section is dimensioned to assist in retaining the impressible material in the cavity when the seal is removed from the lip about the cavity and the moisture is removed from the impressible material;

wherein an impression in the impressible material is viewable through the frame when the frame is mounted on the at least portion of the lip; and wherein the frame is hingedly coupled to the at least one cavity wall such that the frame can be coupled and decoupled from the lip about the cavity by pivoting of the frame relative to the cavity; a flap for covering the frame when the flap is in a closed position and for exposing the frame and the impressible material when the flap is in an open position;

wherein the frame is pressfittedly and releasably coupleable to the lip that extends about the cavity even when the flap is in the open position.

2. The keepsake arrangement as claimed in claim 1, including a hinge to hingedly couple the frame to the at least one cavity wall, wherein the frame and the hinge are integrally formed from plastic.

3. The keepsake arrangement as claimed in claim 1, wherein the impressible material is an air dry modeling compound.

4. The keepsake arrangement as claimed in claim 3, wherein the air dry modeling compound is impressed with the paw print of a pet.

5. The keepsake arrangement as claimed in claim 1, wherein the seal is heat-sealed to the lip about the cavity.

6. The keepsake arrangement as claimed in claim 1, wherein the flap comprises a transparent sleeve;

whereby at least one of a photo, picture and spiritual, emotional and/or inspirational writing can be inserted into the sleeve, is viewable through the sleeve and is readable by a person when the flap is in the opened position.

7. The keepsake arrangement as claimed in claim 1, wherein the frame is open within the shoulder section.

8. A keepsake arrangement, the keepsake arrangement comprising:

a cavity defined by at least one cavity wall, the cavity having an opening and a lip that borders the opening;

an impressible material disposed in the cavity;

a seal, sealingly coupled to the lip about the cavity, for sealing the impressible material in the cavity and for maintaining moisture in the impressible material while the seal is sealingly coupled to the lip about the cavity;

a frame mountable on at least a portion of the lip that extends about the cavity, the frame comprising a shoulder section that extends over at least part of the opening when the frame is coupled to the at least one cavity wall;

wherein the shoulder section is dimensioned to assist in retaining the impressible material in the cavity when the seal is removed from the lip about the cavity and the moisture is removed from the impressible material;

and wherein an impression in the impressible material is viewable through the frame when the frame is mounted on the at least portion of the lip; and a base for supporting the cavity and a flap, hingedly coupled to the base, for covering the frame when the flap is in a closed position and for exposing the frame and the impressible material when the flap is in an open position, wherein the flap is independently removeable from covering the frame such that the frame remains mounted on the at least portion of the lip that extends about the cavity at least when the flap is in the open position; and wherein the flap comprises a transparent sleeve and wherein at least one of a photo, picture and spiritual, emotional and/or inspirational writing can be inserted into the sleeve, is viewable through the sleeve and is readable by a person when the flap is in the opened position.

9. The keepsake arrangement as claimed in claim 8, wherein the frame is pressfittedly mountable on at least a portion of the lip that extends about the cavity and further is hingedly coupled to the at least one cavity wall such that the frame can be coupled and decoupled from the lip about the cavity by pivoting of the frame relative to the cavity.

10. The keepsake arrangement as claimed in claim 8, including a hinge to hingedly couple the frame to the at least one cavity wall, wherein the frame and the hinge are integrally formed from plastic.

11. The keepsake arrangement as claimed in claim 8, wherein the air dry modeling compound is impressed with the paw print of a pet.

12. The keepsake arrangement as claimed in claim 8, wherein the frame is open within the shoulder section.

13. A keepsake arrangement, the keepsake arrangement comprising:

a cavity defined by at least one cavity wall, the cavity having an opening and a lip that borders the opening;

a base for supporting the cavity;

an impressible material disposed in the cavity;

a seal, sealingly coupled to the lip about the cavity, for sealing the impressible material in the cavity and for maintaining moisture in the impressible material while the seal is sealingly coupled to the lip about the cavity;

a frame releasably mountable on at least a portion of the lip that extends about the cavity, the frame comprising a shoulder section that extends over at least part of the opening when the frame is coupled to the at least one cavity wall;

wherein the shoulder section is dimensioned to assist in retaining the impressible material in the cavity when the seal is removed from the lip about the cavity and the moisture is removed from the impressible material;

wherein an impression in the impressible material is viewable through the frame when the frame is mounted on the at least portion of the lip;

wherein the frame is hingedly coupled to the at least one cavity wall such that the frame can be coupled and decoupled from the lip about the cavity by pivoting of the frame relative to the cavity; and a flap, hingedly coupled to the base, for covering the frame when the flap is in a closed position and for exposing the frame and the impressible material when the flap is in an open position; and wherein the flap and the frame are independently rotatable relative to the cavity such that the frame remains mounted on the at least portion of the lip that extends about the cavity at least when the flap is in the open position.

* * * * *